US005758607A

United States Patent [19]

Brendel et al.

[11] Patent Number: 5,758,607

[45] Date of Patent: Jun. 2, 1998

[54] COOLING SYSTEM HAVING AN ELECTRICALLY ADJUSTABLE CONTROL ELEMENT

[75] Inventors: Uwe Brendel, Brunnthal; Josef Krowiorz, Reichertshausen; Norbert Deussen, München, all of Germany

[73] Assignee: Bayerische Motoren Werke Aktiengesellschaft, Germany

[21] Appl. No.: 653,329

[22] Filed: May 24, 1996

[30] Foreign Application Priority Data

May 26, 1995 [DE] Germany ..... 195 19 377.6

[51] Int. Cl.[6] ..... F01P 7/14

[52] U.S. Cl. ..... 123/41.1

[58] Field of Search ..... 123/41.1

[56] References Cited

U.S. PATENT DOCUMENTS

| | | | |
|---|---|---|---|
| 4,545,333 | 10/1985 | Nagumo et al. | 123/41.1 |
| 5,529,025 | 6/1996 | Ranzinger et al. | 123/41.1 |

FOREIGN PATENT DOCUMENTS

| | | |
|---|---|---|
| 0 557 113 A2 | 8/1993 | European Pat. Off. . |
| 44 03 713 | 8/1995 | European Pat. Off. . |
| 19 60 272 | 7/1970 | Germany . |
| 0 011 863 | 6/1980 | Germany . |
| 37 05 232 | 9/1988 | Germany . |
| 41 27 553 | 4/1992 | Germany . |
| 43 24 178 | 1/1995 | Germany . |
| 44 09 547 | 1/1995 | Germany . |
| 43 29 917 | 3/1995 | Germany . |

OTHER PUBLICATIONS

"Adaptive Temperaturregler," Industrie–elektronik+elektronik, 30, Jan. 1985, Nr. 11, pp. 48, 50.

"Adaptive PID–Regler für thermische Prozesse," L. Billmann et al., atp–Automatisierungstechnische Praxis 31, 1989, pp. 327–330.

"Einführung in Grundlagen und spezielle Probleme von Klimaregelungen," Von F. Mesch, Regelungstechnische Praxis 22 Jan. 1980, Heft 8, pp. 259–267.

*Primary Examiner*—Noah P. Kamen

*Attorney, Agent, or Firm*—Evenson, McKeown, Edwards & Lenahan, P.L.L.C.

[57] ABSTRACT

The invention provides a cooling system having an electrically adjustable control element for influencing the coolant temperature of internal-combustion engines in motor vehicles. The system according to the invention has an electronic controller which is connected in front of the control element and which, at least as a function of a quantity influenced by the coolant temperature, generates the control signal quantity for the control of the control element for reaching a desired coolant temperature. The parameters of the controller are determined by means of a basic characteristic diagram and at least one characteristic correction diagram.

7 Claims, 1 Drawing Sheet

COOLING SYSTEM HAVING AN ELECTRICALLY ADJUSTABLE CONTROL ELEMENT

BACKGROUND AND SUMMARY OF THE INVENTION

This invention relates to a cooling system having an electrically adjustable control element for influencing the coolant temperature of an internal-combustion engine in a motor vehicle.

Such a cooling system is known, for example, from German Patent Document DE 43 24 178 A1, which has an electrically adjustable thermostatic valve for regulating the temperature of the coolant in warm-up, mixed operation and radiator operation. The electrically adjustable thermostatic valve contains an expansion element which can be electrically heated to reduce the coolant temperature.

In this known cooling system, the thermostatic valve adjusts the flow of the coolant so that, during warm-up, coolant coming from the engine essentially bypasses the radiator, and flows back to the engine through a short circuit. During mixed operation, coolant from the engine flows partly through the radiator and partly through the short circuit. Finally, during the radiator operation, coolant from the engine flows primarily through the radiator. Electrically heating the electrically adjustable control element enlarges the opening cross-section for the flow of the coolant to the radiator relative to an opening cross-section attributable solely to the temperature of the coolant.

Electric heating of the electrically adjustable control element is performed by a control device which detects the actual coolant temperature and compares it with a given desired coolant temperature. If the detected actual coolant temperature is above the desired coolant temperature, the electric heater is switched on to cool the coolant. If the actual coolant temperature is below the given desired coolant temperature, the electric heater of the electrically adjustable control element is switched off.

This known cooling system performs only a two-point control, simply by comparing the actual coolant temperature and the desired coolant temperature. Thus, considerable undershooting or overshooting may take place relative to the desired coolant temperature.

Furthermore, German Patent Document DE 44 03 713, which is not a prior publication, discloses a cooling system having an electrically adjustable coolant delivery pump for influencing the coolant temperature in an internal-combustion engine. However, concerning this known cooling system, no control process is described, particularly with respect to the rotational speed control of the coolant delivery pump.

An object of the invention is to provide an improved cooling system of the type described above, which prevents undershooting and overshooting of the given desired coolant temperature, and reaches the desired coolant temperature as fast as possible.

This object is achieved by the cooling system according to the invention, in which a PID (Proportional, plus Integral, plus derivative) feedback control system of the type that is known per se is used to control the electrically adjustable thermostatic valve. This arrangement achieves optimum control of the coolant temperature as noted. The parameters of the controller are provided by means of a basic lookup table or map and at least one correction lookup table or map.

It has been found in tests that a PID-controller is particularly suitable for controlling an electronically or electrically adjustable control element to influence the coolant temperature of an internal-combustion engine. Such control minimizes the time required to reach the predetermined desired coolant temperature. The PID-controller may be of either analog or digital design and may, for example, be integrated into an electronic control unit (which is provided in any case), for controlling the cooling system and/or the engine. Particularly when a digital PID-controller is used, the costs and effort for a cooling system according to the invention will be slight, despite an improved control. However, the controller may also be another electronic controller, such as a $PI_nD_n$ or a PI-controller. Preferably, the controller is designed corresponding to a physical model of the cooling process.

Conventional PID controllers of the type referred to above are well known to those skilled in the art, and provide a control action in which the output is proportional to a linear combination of the input, the time integral of the input and the time rate of change (derivative) of the input. (See, for example, IEEE *Standard Dictionary of Electrical and Electronic Terms*, 4th ed. 1988, pp 198–99). This relationship can be expressed by the following equation, which is also well known:

$$\frac{Y}{X} = \pm P \frac{1 + sD}{1 + sD/a}$$

where:

X=Input
Y=Output
a=derivative action gain (a>1.0)
b=proportional gain/static gain
D=Derivative action time constant
I=Integral action rate
P=Proportional gain
s=complex variable As noted hereinafter, the values of the above parameters are determined by empirical measurements in a conventional manner, during driving tests, and are stored in the lookup tables.

It should also be pointed out that the quantity influenced by the coolant temperature may be the coolant temperature itself. Moreover, the control signal quantity may also be generated as a function of additional operating parameters.

According to the invention, the term "lookup table" includes a stored characteristic curve, and/or a corresponding algorithm. Preferably, the controller is integrated into an electronic control unit in which the lookup tables, characteristic curves, and/or algorithms are stored.

Determination of the control parameters from a basic lookup table and a correction lookup table permits very fast control by determining a pilot control value from the basic lookup table. It also achieves precise control by virtue of a correction value determined from the correction lookup table, for example, toward the reaction after the indication of the pilot control value.

In one advantageous embodiment of the invention, the parameters of the controller are determined from a basic lookup table and at least one correction lookup table. The lookup tables are accessed based on at least one operating parameter. The correction lookup table takes into account the control difference (the difference between the actual coolant temperature and the desired temperature).

The basic lookup table according to the invention preferably takes into account the actual coolant temperature and the rotational speed of the engine. In the case of a PID-controller or of a PI-controller, separate correction lookup tables are preferably provided for the I-proportion and the P-proportion of the controller, respectively. These correction lookup tables take into account at least the control difference. According to the invention, additional operating parameters may also be reflected in the basic lookup table as well as in the correction lookup table(s). These include the momentary position of the control element, the engine load, the electrical wiring voltage, the vehicle speed, the outside temperature, the switching condition of the air-conditioning unit and/or wind influences.

In another advantageous embodiment of the invention the values of the basic lookup table and the correction lookup tables are added to determine the parameters of the controller. Other operating parameters may of course also be taken into account. These embodiments achieve precise adaptation of the parameters of the controller to the instantaneous operating conditions of the vehicle In another advantageous embodiment of the invention, the control signal quantity is preferably a pulse-width-modulated signal. As a result, highly sensitive control of the control element is possible because pulse-width-modulated signals customarily achieve a resolution of at least 1%.

Other objects, advantages and novel features of the present invention will become apparent from the following detailed description of the invention when considered in conjunction with the accompanying drawings.

DETAILED DESCRIPTION OF THE DRAWINGS

Figure 1:
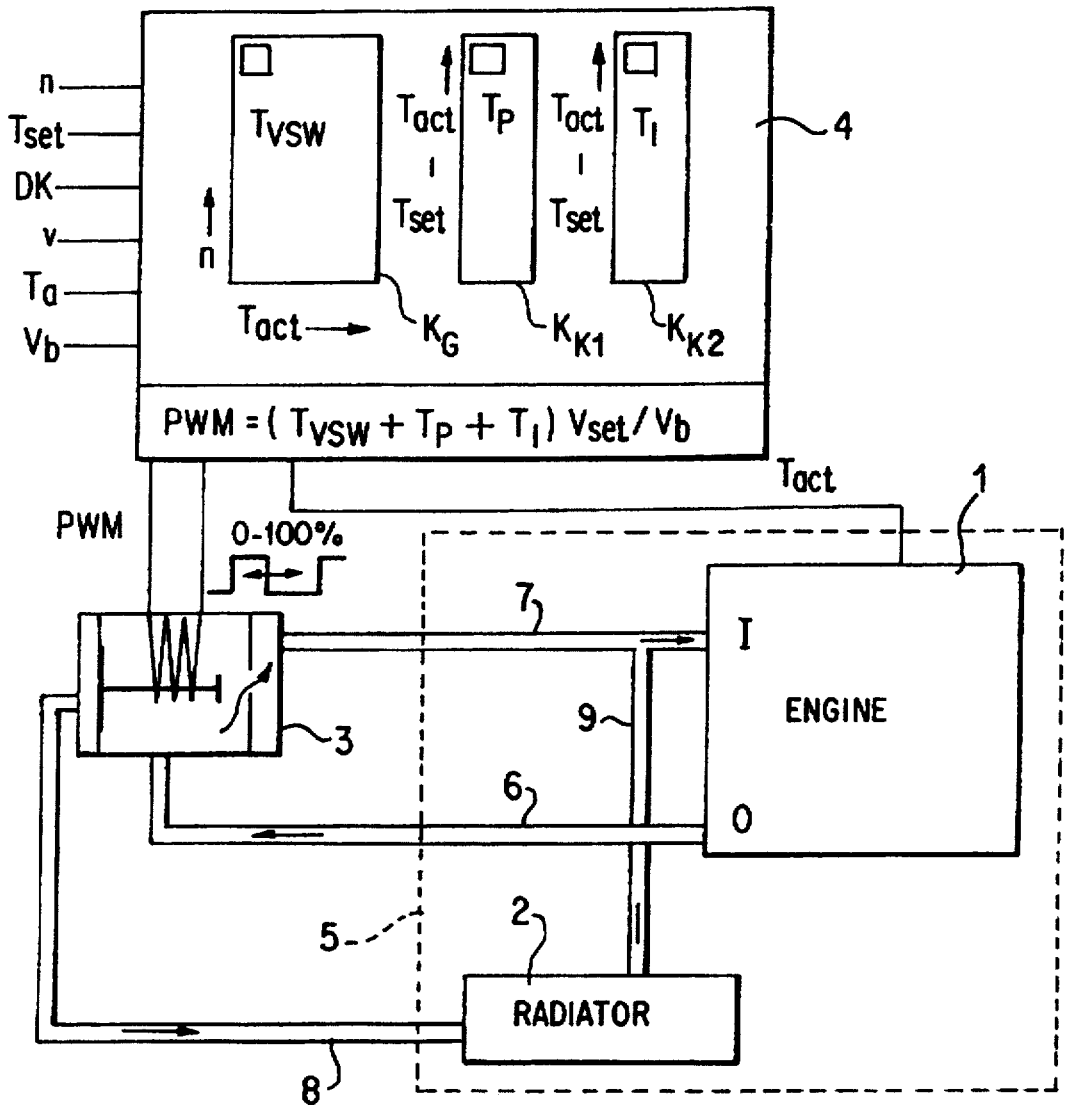
FIG. 1 is a view of a cooling system according to the invention with a controller whose parameters are determined by a basic lookup table and two correction lookup tables.

Referring to FIG. 1, an output O of the cooling system of an engine 1 is connected by a coolant conducting line 6 with an input of an electrically adjustable control element 3, such as a thermostatic valve. An output of control element 3 is connected through another line 7 and input I, to the cooling system of engine 1. Another output of control element 3 runs through a line 8 to the input of a radiator 2, which in turn is connected through a coolant line 9 with input I of engine 1.

The electrically adjustable thermostatic valve 3 has a temperature-dependent element made of expandable material that can be heated by an electrical line connected to an electronic control device 4. Such electrically adjustable thermostatic valves are well known in the art, such as that disclosed, for example, in German patent document DE 43 24 178 A1.

FIG. 1 illustrates the control element 3 during warm-up operation. Coolant is returned from outlet A of the engine 1 in a type of short circuit via the control element 3 and coolant lines 6 and 7, back to the inlet I of the engine 1, bypassing the radiator 2. After warm-up of the coolant to the operating temperature, the control element 3 is controlled so that in both mixed and radiator operation the coolant is guided at least partially by way of coolant lines 8 and 9, through the radiator 2. The more the control element 3 is heated in response to the control signal PWM, the more the control element 3 is displaced in the radiator operation direction. That is, the right-hand passage, shown here in a completely open position, is progressively closed, while the left-hand passage, shown here in a completely closed position, is opened correspondingly.

The pulse width modulated control signal (PWM) is output by the PID-controller 4, which may also be integrated in an electronic control unit. As an input signal, the PID-controller 4 receives at least the actual coolant temperature $T_{act}$ from the internal-combustion engine 1. In addition, the following are examples of input signals that may also be fed to the PID-controller 4: the rotational speed n of the engine, the desired coolant temperature $T_{set}$, the throttle valve angle DK, the vehicle speed, v, the outside (ambient) temperature $T_a$, and/or the electrical wiring voltage $V_b$.

Three lookup tables are stored in the PID-controller 4. The required parameters are determined in a conventional manner by empirical measurement during driving tests. The measured results are stored in form of tables.

The basic lookup table $K_G$ provides, a pilot value $T_{VSW}$, for example as a function of the actual coolant temperature $T_{act}$ and of the rotational speed n of the engine. In addition, a first correction value $T_P$ is determined for the P-proportion of the PID-controller 4 by way of the first characteristic correction diagram $K_{K1}$. A second correction value $T_I$, for the I-proportion of the PID-controller 4 is determined by way of the second characteristic correction diagram $K_{K2}$. These first and second correction values $T_P$, and $T_I$, are determined at least as a function of the control difference $T_{set}-T_{act}$. According to the invention, it is also possible to use only one characteristic correction diagram $K_{K1}$ or $K_{K2}$ if no such high demands are made on the precision of the controller.

The pulse-width-modulated control signal PWM controls the control element 3. According to the invention, the mark-to-space ratio of the control signal PWM is preferably determined according to the following:

$$PWM=(T_{vsw}+T_p+T_I)V_{set}/V_b$$

in which $V_b$ is the actual electrical wiring voltage and $T_{vsw}$, $T_p$ and $T_1$, are determined as discussed above.

According to this formula, after the addition of the values obtained from the basic lookup table ($T_{vsw}$) and correction lookup tables ($T_p$, $T_I$), the ratio of the desired electrical wiring voltage $V_{set}$ to the actual electrical wiring voltage $V_b$ is applied as a correction factor. Additional operating parameters, such as the throttle valve angle DK, the vehicle speed v and the outside (ambient) temperature $T_a$ may of course also be taken into account.

Figure 2:
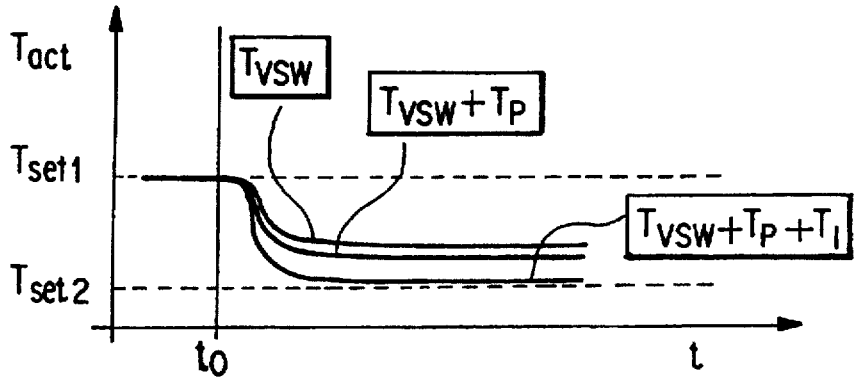
FIG. 2 is a view of the response of the actual coolant temperature achieved by the use of different lookup tables.

FIG. 2 compares the control quality achieved by the use of different lookup tables for determining the control signal PWM. In FIG. 2, the actual coolant temperature $T_{act}$ is shown as a function of time t. At the point in time $t_0$, the given desired coolant temperature $T_{set1}$ is changed to the desired coolant temperature $T_{set2}$. The upper curve of the diagram illustrates the control behavior when only the pilot control signal value $T_{vsw}$ of the basic lookup table $K_G$ is used to determine the control signal quantity PWM. The center curve of the diagram in FIG. 2 shows the control behavior achieved when the basic lookup table $K_G$ and only one correction lookup table $K_{K1}$ are used. That is, the center curve is the result of a control signal obtained by adding at least the values $T_{vsw}$ and $T_p$. Compared to the upper curve, it already shows a better control quality.

The lower curve in FIG. 2 shows the result achieved when the control signal quantity PWM is obtained by adding the values $T_{vsw}$, $T_p$ and $T_1$. Compared to the other curves in FIG. 2, the bottom curve shows the best control quality. That is, in the lower curve, the new desired coolant temperature $T_{set2}$ is reached more quickly. On the other hand, in the case of all three curves, by using the PID-controller 4 according to the invention, the newly given desired coolant temperature $T_{set2}$ is reached without any undershooting or overshooting.

Thus, by means of the embodiment according to the invention, optimum control is achieved. That is, based on the available information concerning operating parameters, very fast and precise adjustment of the given desired coolant temperature is possible.

The invention is not limited, however, to the above-mentioned embodiment. Thus, for example, instead of or in addition to the thermostatic valve 3, a cooling delivery pump provided in the coolant circulating system may also be controlled according to the invention. Similarly an electrically controllable coolant throttle valve may be used. Basically, the invention relates to any control element which can be electrically or electronically controlled for influencing the coolant temperature.

Furthermore, the control signal quantity need not necessarily be a pulse-width-modulated signal. Depending on the design of the control element, it may also be an arbitrarily suitable electrical signal, such as an adjusting-path-proportional voltage signal or a frequency-modulated pulse.

Finally, instead of the coolant temperature itself, another quantity influenced by the coolant temperature (for example, the temperature of a component through which the coolant flows) may be used for control purposes.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. Cooling system for an internal combustion engine, comprising:

an electrically adjustable control element for influencing the coolant temperature of the internal-combustion engine; and an electronic controller for generating a control signal to control the control element to achieve a desired coolant temperature at least as a function of a quantity influenced by actual coolant temperature, said function being variable in accordance with operating parameters of the controller;

said operating parameters of the controller being determined by reading values from a basic lookup table and at least one correction lookup table, based at least on sensed values of said quantity influenced by the actual coolant temperature, whereby a feedback response of said electronic controller is varied in accordance with values read from said lookup tables.

2. Cooling system according to claim 1 wherein the basic lookup table is determined taking into account at least one operating parameter and the correction lookup table is determined taking into account a control difference.

3. Cooling system according to claim 1 wherein for determining the parameters of the controller, values determined from the basic lookup table and from the correction lookup table are added.

4. Cooling system according to claim 1 wherein the control signal quantity is a pulse-width-modulated signal.

5. Cooling system for an internal combustion engine comprising:

a radiator;

coolant lines for conducting a flow of coolant between said radiator and said internal combustion engine;

an electrically controlled valve for controlling a flow of coolant from said engine through said radiator;

means for inputting a desired set temperature;

means for detecting a quantity proportional to an actual temperature of said engine coolant; and a control unit for controlling said electrically controlled valve in response to said actual temperature and said set temperature, said control unit having operating parameters which define a functional relationship between an output control signal of said control unit and temperature values input thereto, wherein said operating parameters are determined by reading values from a basic lookup table and at least one correction lookup table, based at least on said quantity proportion to said actual temperature, whereby said functional relationship is varied in accordance with values read from said lookup tables.

6. Cooling system according to claim 4 wherein said electronic control unit is a PID element.

7. Method of operating a temperature control system for an engine coolant in an internal combustion engine, said temperature control system comprising an electrically adjustable control element to influence coolant temperature, a sensor for determining a value of a variable which is indicative of said coolant temperature, and an electronic regulator for generating a control signal to control the control element to achieve a desired coolant temperature as a function of said value of said variable, wherein said function is dependent upon a plurality of processing parameters of said electronic regulator, said method comprising the steps of:

detecting operating parameters of said internal combustion engine; and determining said processing parameters of said electronic regulator by reading values from a basic lookup table and at least one correction lookup table, based on at least a sensed value of said variable which is indicative of said coolant temperature of the internal combustion engine, whereby a response of said electronic regulator is varied in accordance with values read from said lookup tables.

* * * * *